US005881925A

United States Patent [19]

Ando

[11] Patent Number: 5,881,925

[45] Date of Patent: Mar. 16, 1999

[54] ATOMIZER OF RECIPROCATING PUMP TYPE

[75] Inventor: Yasunori Ando, Tokyo, Japan

[73] Assignee: Mitani Valve Co., Tokyo, Japan

[21] Appl. No.: 820,942

[22] Filed: Mar. 19, 1997

[30] Foreign Application Priority Data

Mar. 22, 1996 [JP] Japan ..... 8-093286
Feb. 13, 1997 [JP] Japan ..... 9-044708

[51] Int. Cl.[6] ..... B67D 5/58

[52] U.S. Cl. ..... 222/190; 222/321.2; 222/346

[58] Field of Search ..... 222/190, 321.2, 222/321.7, 321.9, 345, 346

[56] References Cited

U.S. PATENT DOCUMENTS

| | | | |
|---|---|---|---|
| 3,118,568 | 1/1964 | Bishop et al. | 222/43 |
| 3,143,252 | 8/1964 | Shapiro | 222/309 |
| 3,491,916 | 1/1970 | Graham | 222/190 |
| 4,140,249 | 2/1979 | Majima | 222/321 |
| 4,511,065 | 4/1985 | Corsette | 222/153 |
| 4,583,692 | 4/1986 | Sheffler | 239/405 |
| 4,768,714 | 9/1988 | Luchsinger | 239/142 |
| 4,928,857 | 5/1990 | Ecker | 222/190 |
| 5,156,307 | 10/1992 | Callahan et al. | 222/190 |

FOREIGN PATENT DOCUMENTS

| | | | |
|---|---|---|---|
| 0346167 | 12/1989 | European Pat. Off. | 222/321.2 |
| 4-35555 | 3/1992 | Japan . | |
| 1163444 | 9/1969 | United Kingdom . | |
| 9313873 | 7/1993 | WIPO | 222/321.2 |

*Primary Examiner*—Joseph A. Kaufman
*Attorney, Agent, or Firm*—Venable; Robert J. Frank; Catherine M. Voorhees

[57] ABSTRACT

In the reciprocating pump P, the pressure chamber 30 is formed by an atomizing tube 15, a piston 28, and a cylinder 20. The pressure chamber 30 has a check valve 24 that opens and closes the inlet of the said pressure chamber 30 and a ball-shaped stirring material 25 moving freely in the pressure chamber 30 that stirs the mixture in the pressure chamber 30. On the other hand, pumping space is formed by the piston 28 and the cylinder 20 in the reciprocating pump P, apart from the pressure chamber 30. The pumping space 29 is occupied by the mixture pumped up when the push button 17 is returned to its home position and communicating holes are provided through which the mixture is discharged into the container 10 when the push button is pressed. The atomizer of an reciprocating pump type of the present invention can stir sufficiently and atomize a liquid-powder mixture when used.

10 Claims, 12 Drawing Sheets

ATOMIZER OF RECIPROCATING PUMP TYPE

BACKGROUND OF THE INVENTION

The present invention relates to an atomizer of the reciprocating pump type that has a reciprocating pump at the mouth of a container. More particularly, it relates to an atomizer for cosmetic and medical use that atomizes a mixture of a liquid such as water, alcohol and powder such as medicines and cosmetics housed in the container by pressing the push button on the reciprocating pump and releasing the pressing of the button.

Conventionally, atomizers that spray a mixture of liquid and powder are available in types such as aerosol bombs that use an atomizing agent. The above aerosol bomb has both a mixture and an atomizing agent housed in a container and a push button at the end of an atomizing tube from the container. When used, the bomb is first held in the user's hand and shaken well to stir a mixture in the container sufficiently. When the push button is pressed with the user's finger, the atomizing tube is pushed in and opens the valve. Then the mixture through the atomizing tube is atomized through the nozzle provided in the push button.

However, such a conventional atomizer has a problem of not being capable of atomizing a mixture stirred sufficiently when used, because the atomizer, even if shaken well before use, allows powder to start to precipitate when the user stops shaking the atomizer.

An object of the invention therefore is to provide an atomizer of reciprocation pump type that is capable of stirring a mixture sufficiently and atomizing both powder and a liquid when used.

SUMMARY OF THE INVENTION

According to the present invention, the atomizer has a mixture of a liquid and powder housed in a container and a reciprocating pump at the mouth of the container. By pressing the push button on the reciprocating pump and pressing the push button again for releasing purposes, the reciprocating pump sucks up the above-mentioned mixture in the fore-mentioned container. Then the atomizer atomizes the mixture, that has reached a pressure chamber, through the nozzle. The atomizer is provided with a stirring member that moves freely in the pressure chamber to stir a mixture in the above-mentioned pressure chamber.

Furthermore, the atomizer of the reciprocating pump type according to the present invention, for example, comprises a container that houses a mixture of a liquid and powder and a reciprocating pump provided at the mouth of the container. The reciprocating pump is provided with an internal passage that leads to the nozzle, a push button that is capable of being pressed with a finger, a piston which is pushed down by pressing the push button, a cylinder housing within which the piston slides vertically, a pressure chamber formed with the cylinder and the piston that has an inlet leading to the inside of the container and an outlet leading to the internal passage in the push button, an outlet valve provided at the outlet of the pressure chamber that moves against the force energized by the pressure in the pressure chamber which is increased when the piston is pressed by the push button to open the above outlet, an energizing member that returns the push button to its home position together with the piston when the finger becomes separated from the button, a check valve provided at the entrance of the pressure chamber that makes the pressure in the pressure chamber negative when the push button is returned to its home position together with the piston to open the entrance of the pressure chamber, and a stirring member moving freely inside the pressure chamber for stirring the mixture pumped up into the pressure chamber.

In the atomizer of the reciprocating pump type of this invention, when the atomizer is used, a mixture is pumped up from the container to a pressure chamber by pressing the push button and releasing the pressed button and the mixture pumped up is atomized through a nozzle in the push button. At the time, a flow of the mixture in the pressure chamber causes the stirring member to dance, thus stirring the mixture in the pressure chamber.

Further, the atomizer of the reciprocating pump type of the present invention, for example, has a mixture of a liquid and powder housed in a container and a reciprocating pump at the mouth of the container. By pressing the push button on the reciprocating pump and pressing the push button again for a releasing purpose, the mixture is pumped up from the container to a pressure chamber and then atomized through the nozzle in the push button. In the atomizer of the reciprocating pump type of the present invention, the piston pushed down when the push button is pressed and the cylinder that houses the piston which is slidable in the cylinder forms a pumping space apart from the pressure chamber. The atomizer of the reciprocating type of the present invention is provided with communicating holes for discharging the mixture that has been pumped up into the pumping space during the return of the push button released to its home position into the container when the push button is pressed again.

In other aspect of the invention, the atomizer of the reciprocating pump type according to the present invention, comprises a container that houses a mixture of a liquid and powder and a reciprocating pump provided at the mouth of the container. The reciprocating pump is provided with an internal passage that leads to the nozzle, a push button that is capable of being pressed with a finger, a piston that is pushed down when the push button is pressed, a cylinder which houses the piston that slides vertically inside, a pressure chamber formed with the cylinder and the piston that has an inlet leading to the inside of the container and an outlet leading to the internal passage in the push button, an outlet valve provided at the outlet of the pressure chamber that moves against the force energized by the pressure of the pressure chamber increased when the piston is pressed by the push button pressed to open the above outlet, an energizing member that returns the push button to its home position together with the piston when the finger becomes separated from the button, a check valve provided at the entrance of the pressure chamber that makes the pressure in the pressure chamber negative when the push button is returned to its home position together with the piston to open the entrance of the pressure chamber, and a pumping space formed by the cylinder and the piston apart from the pressure chamber and communicating with the container through communicating holes, which holds a mixture from the container during the return of the push button to its home position with the finger off the button and discharges the mixture into the container when the push button is pressed again.

In these cases, when the atomizer of the reciprocating pump type of the present invention is used, by pressing and releasing the push button, the pressed mixture is pumped up from the container to the pressure chamber and the mixture pumped up is atomized through the nozzle in the push button. At the same time, the mixture in the container is fed into the pumping space and the mixture in the pumping space is discharged into the container through the communicating holes to stir the mixture in the container.

Furthermore, according to the present invention, the atomizer of the reciprocating pump type has a mixture of a liquid and powder housed in a container and a reciprocating pump at the mouth of the container. By pressing the push button on the reciprocating pump and pressing the push button again for releasing, the mixture is pumped up from the said container to the pressure chamber and then atomized through the nozzle in the said push button. The atomizer of the reciprocating type is provided with a stirring member that moves freely in the pressure chamber to stir a mixture in the above-mentioned pressure chamber, a pumping space formed, apart from the pressure chamber, by the pushed down piston and the cylinder that houses the piston which slides freely therein and communicating holes for discharging the mixture that has been pumped up into the pumping space during the return of the push button which has been released to its home position into the container when the push button is pressed again.

When the atomizer of the reciprocating pump type of the present invention is used, a mixture is pumped up from the container to a pressure chamber by pressing the push button and releasing the pressed button and the mixture pumped up is atomized through the nozzle in the push button. At the time, a flow of the mixture in the pressure chamber dances the stirring member, thus stirring the mixture in the pressure chamber. At the same time, the mixture in the container is fed into a pumping space and some of the mixture in the pumping space is discharged into the container through the communicating holes to stir the mixture in the container.

According to the atomizer of the reciprocating pump of this invention, the pressure chamber communicates with the pumping space at the last stage of the push-down of the push button.

At the last stage of the push-down of the push button, the pressure chamber is in communication with the pumping space and with the container through the communicating holes, thus returning the pressure of the pressure chamber to the atmospheric pressure.

Furthermore, the above-mentioned atomizer of reciprocating pump type is provided with the stirring member shaped like a ball.

PREFERRED EMBODIMENTS

The preferred embodiments of the present invention will hereinafter be described in detail with reference to the attached drawings.

Figure 2:
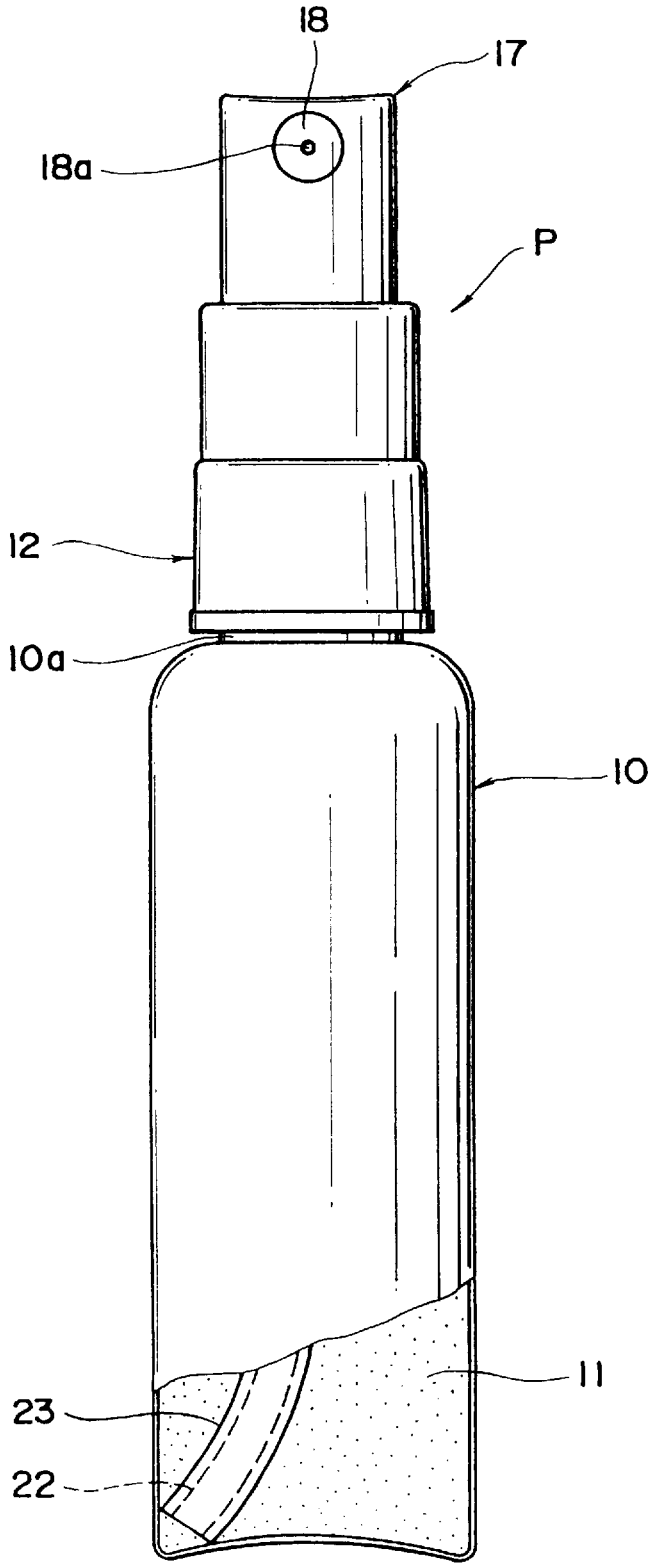
FIG. 2 is a front view of the whole atomizer with a partially cutaway view of the container.

FIG. 2 is a front view of an embodiment of the atomizer of the reciprocating pump type of the present invention, partial cutting away the container. The atomizer is of the reciprocating pump type. The reciprocating pump P is provided at a mouth 10*a* of the container 10.

The container 10 is made of resin and shaped like a bottle and holds a mixture 11 therein. The mixture 11 consists of a liquid such as water, alcohol, chemical, toilet water, perfume and powder such as nylon corpuscle, medicine, cosmetic, and perfume. Liquid and powder can be mixed, for example, to keep some medicine good or to improve visual effects.

Figure 1:
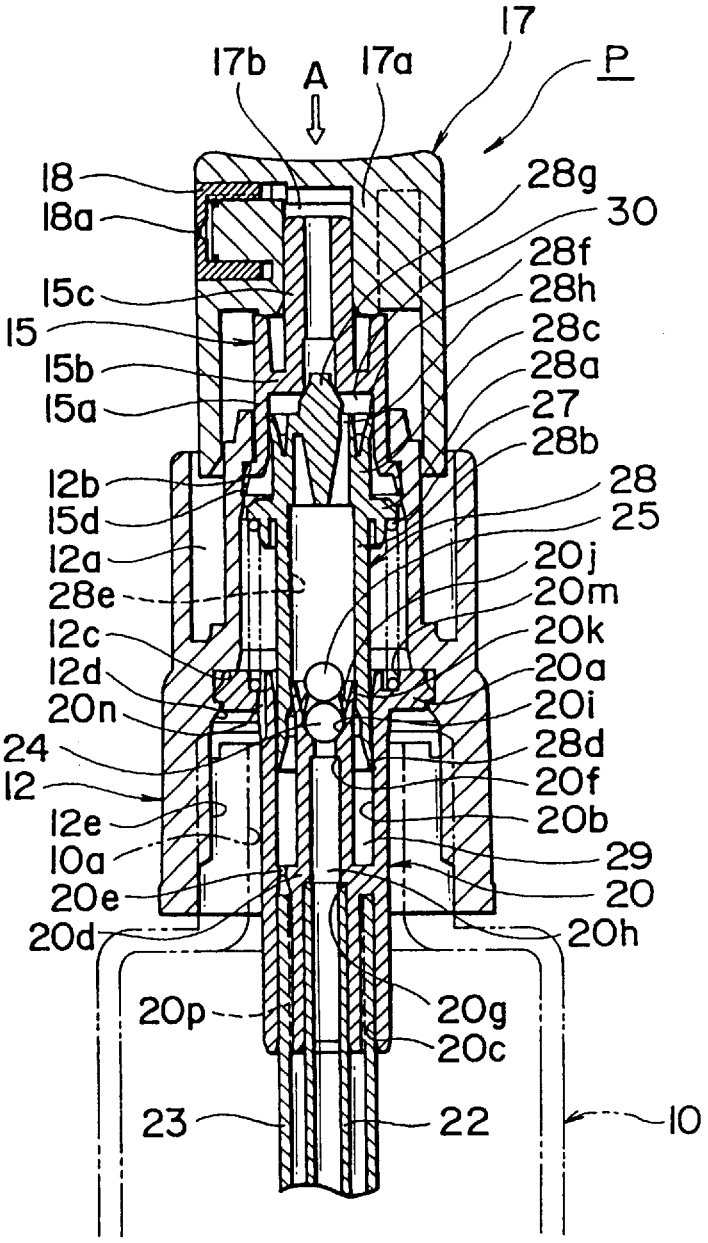
FIG. 1 is a view for showing the longitudinal section of an embodiment of the present invention.

The reciprocating pump P is provided with a fixed cylindrical member 12, as shown in FIG. 1. The fixed cylindrical member 12 is slightly thick and cylindrical in shape. The fixed cylindrical member 12 has an upward circular concave groove 12*a* that is open upward, a downward upper part 12*b* and a lower part 12*c*, a circumferential projection 12*d* projecting inward directly under the lower part 12*c*, and a lower inside circumferential surface 12*e* with a female screw inside.

The atomizing tube 15 enters into the fixed cylindrical member 12 from below and the top of the atomizing tube 15 projects beyond the top of the fixed cylindrical member 12. The atomizing tube 15 comprise a large-diameter tube part 15*a*, a connection part 15*b* that extends inward beneath nearly the center of the large-diameter tube part, and a small-diameter tube part 15*c* that rises upward from the inner circumferential surface. While an expand part 15*d* that expands slightly outward is provided at the bottom ends of the large-diameter tube part 15*a*, the top of the small-diameter part 15*c* projects beyond the top of the large-diameter part 15*a*. The bottom ends of the outward-expand part 15*d* slide freely against the inside surface of the top of the fixed cylindrical member 12.

The top of the small-diameter part 15*c* of the atomizing tube 15 is squeezed into an internal passage 17*b* in a push button 17, and the push button 17 is attached to the atomizing tube 15. The push button 17 is of the cylindrical shape having the top part 17*a* and the top part 17*a* has the passage 17*b* inside. The internal passage 17*b* has a hole at its outer circumference, and the hole is provided with a nozzle member 18. The nozzle member 18 has a nozzle 18*a* that leads to the internal passage 17*b*. The top part 17*a* is in contact with the top of the large-diameter part 15*a* of the atomizing tube 15, and the bottom-end part of the top part 17*a* is in the upward circular groove 12*a* of the fixed cylindrical member 12.

The reference numeral 20 shows a cylinder. The cylinder 20 is of a thick cylindrical shape with a collar 20*a* at the top end and has an upward circular hole 20*b* that is open upward and a downward circular hole 20*c* that is open downward. The partition part 20*d* between the upward circular hole 20*b* and the downward circular hole 20*c* is provided with plural communicating holes 20*e*. The cylinder 20 has downward step parts 20*f* and 20*g* halfway in the center, a conical valve seat 20*i* directly above the step part 20*h* with its diameter larger upward, and plural projections 20*j* that tilt upward at the circumferential surface slightly above the conical valve seat 20*i*. The cylinder 20 has a squeezed part 20*k* opening slightly outward between a passage 20*h* and the upward circular hole 20*b*. The collar 20*a* of the cylinder 20 has a circular concave part 20*m* at the top and a through hole 20*n* at the bottom.

The large-diameter pipe 23 holds the small-diameter pipe 22 to form a double pipe. The top end of the small-diameter pipe 22 is squeezed into the bottom of the passage 20*h* to strike the top end with a step part 20*g* so that the said small-diameter pipe 22 will communicate with the passage 20*h*. In addition, the top end of the large-diameter pipe 23 is squeezed into the downward circular hole 20*c* so that the large-diameter pipe 23 will communicate with the upper circular hole 20*b* through the communicating holes 20*e* and a longitudinal groove 20*p* of the cylinder 20 formed inside the downward circular hole 20*c*.

On the other hand, the ball-shaped check valve 24 is squeezed into plural projections 20*j* to seat the check valve 24 on the conical valve seat 20*i* and to seat ball-shaped stirring member 25 on the projections 20*j*.

The bottom end of an energizing member 27, such as coil springs, is placed in the circular concave part 20*m* and a spring retainer 28*a* is placed on the top end of the energizing member 27 to form a piston 28.

The piston 28 has a spring retainer 28*a* at the outer circumference of the bore 28*b* and the bore 28*b* has a top 28*c*. The bore 28*b* has a squeezed part 28*d* that expands slightly outward at the bottom. The bore 28*b* has a longitudinal communicating concave groove 28*e* at its inner circumference and a squeezing part 28*f* that expands slightly outward from the center. The bore has an outlet valve 28*g* that projects upward at the center of the bore 28, and there are plural through holes 28*h* formed from the outlet valve 28*b* to the piston 28. The bottom end of the bore 28*b* is inserted into the upward circular hole 20*b* in the cylinder 20 so that the squeezed part 28*d* will be in contact with the internal circumferential surface of the upward circular hole 20*b* and the squeezed part 20*k* of the cylinder 20 is brought into contact with the internal circumferential surface of the bore 28*b* so that the squeezed part 20*k* will be inserted into cylinder 20 to allow the piston 28 to slide freely.

The piston 28 enters the fixed cylindrical member 12 so that the squeezed part 28*f* will be in contact with the internal circumferential surface of the large-diameter part 15*a*. The outlet valve 28*g* of the piston 28 is inserted upward into the small-diameter part 15*c* of the atomizing tube 15 to squeeze the outer circumference of the said outlet valve 28*g* against the internal inlet of the small-diameter part 15*c*. In addition, the expanding part 15*d* of the atomizing tube 15 is pushed up by the piston 28 to squeeze the expanding part 15*d* against the step part 12*b* of the fixed cylindrical member 12. Then the cylinder 20 is inserted upward into the fixed cylindrical member 12 while the energizing member 27 is being compressed. The collar 20*a* of the said cylinder 20 is struck against the step part 12*c* and hooked by the projection 12*d* to assemble the cylinder 20 and the piston 28 together inside the fixed cylindrical member 12. Then there is a pressure chamber 30, formed by the atomizing tube 15, the piston 28, and the cylinder 20, that communicates with the container 10 through through-holes 28*h*, apart from the pumping space 29.

Thus the reciprocating pump P inserts the large-diameter pipe 23 into the mouth 10*a* of the container 10. As shown in FIG. 2, the mouth 10*a* is covered with the fixed cylindrical member 12 and screwed into the said fixed cylindrical member 12. The large-diameter pipe 23 is placed closely to the bottom of the container 10.

When the above-mentioned atomizer is used, the container 10 is held in the hand and shaken well to agitate a mixture 11 in the container 10 and to allow the stirring member 25 shown in FIG. 1 to stir a mixture 11 in the pressure chamber 30.

Then, when the push button 17 is pressed against the energizing member 27 by hand as indicated by an arrow A in FIG. 1, the piston 28 is pushed in through the atomizing tube 15 to increase the pressure in the pressure chamber 30. When the pressing force of the piston 28 exceeds the force of the energizing member 27, the piston moving toward the atomizing tube releases the squeezing of the outlet valve 28*g* and opens the outlet of the pressure chamber 30, thus making it possible for the small-diameter part 15*c* of the atomizing tube 15 to communicate with the pressure chamber 30. The mixture in the pressure chamber 30 is then sent out to the small-diameter part 15*c*, thus atomizing the mixture 11 through the passage 17*b* in the push button 17, with great force, through the nozzle 18*a* of the nozzle member 18 into the open air.

Figure 4:
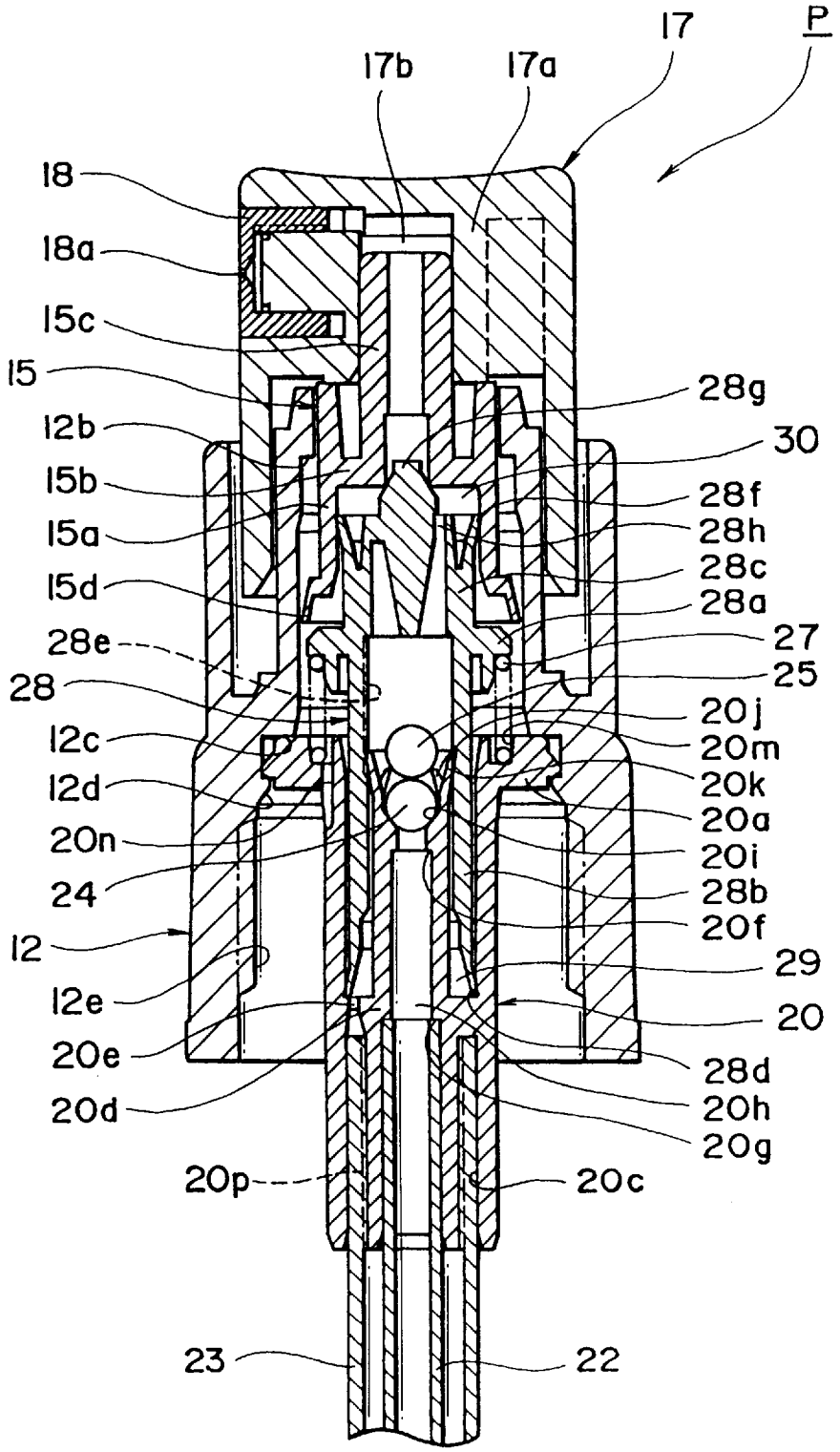
FIG. 4 is a view for showing the state at the last stage of the push-down of the push button.

When the communicating concave groove 28*e* in the bore 28*b* reaches the squeezed part 20*k* with the push button 17 completely pressed, the pressure chamber 30 communicates with the pumping space 29 in the cylinder 20 through the communicating concave groove 28*e*, and then with the container 10 through the communicating holes 20*e* and groove 20*p* and the large-diameter pipe 23. As a result, the residual pressure is relieved from the pressure chamber 30 through the communicating concave groove 28*e* into the container 10, thus making the pressure chamber 30 return to the atmospheric pressure, as shown in FIG. 4. At the same time, the mixture 11 being discharged from the pumping space 29 to the container 10 stirs the mixture 11 in the container 10.

Thus, the outlet valve 28*g* of the piston 28 is squeezed again against the inlet in the small-diameter part 15*c* by the energizing member 27, as illustrated, and the outlet of the pressure chamber 30 is then closed, thereby cutting the communication between the small-diameter part 15*c* and the pressure chamber 30 and stopping the atomization through the nozzle 18*a*.

Figure 5:
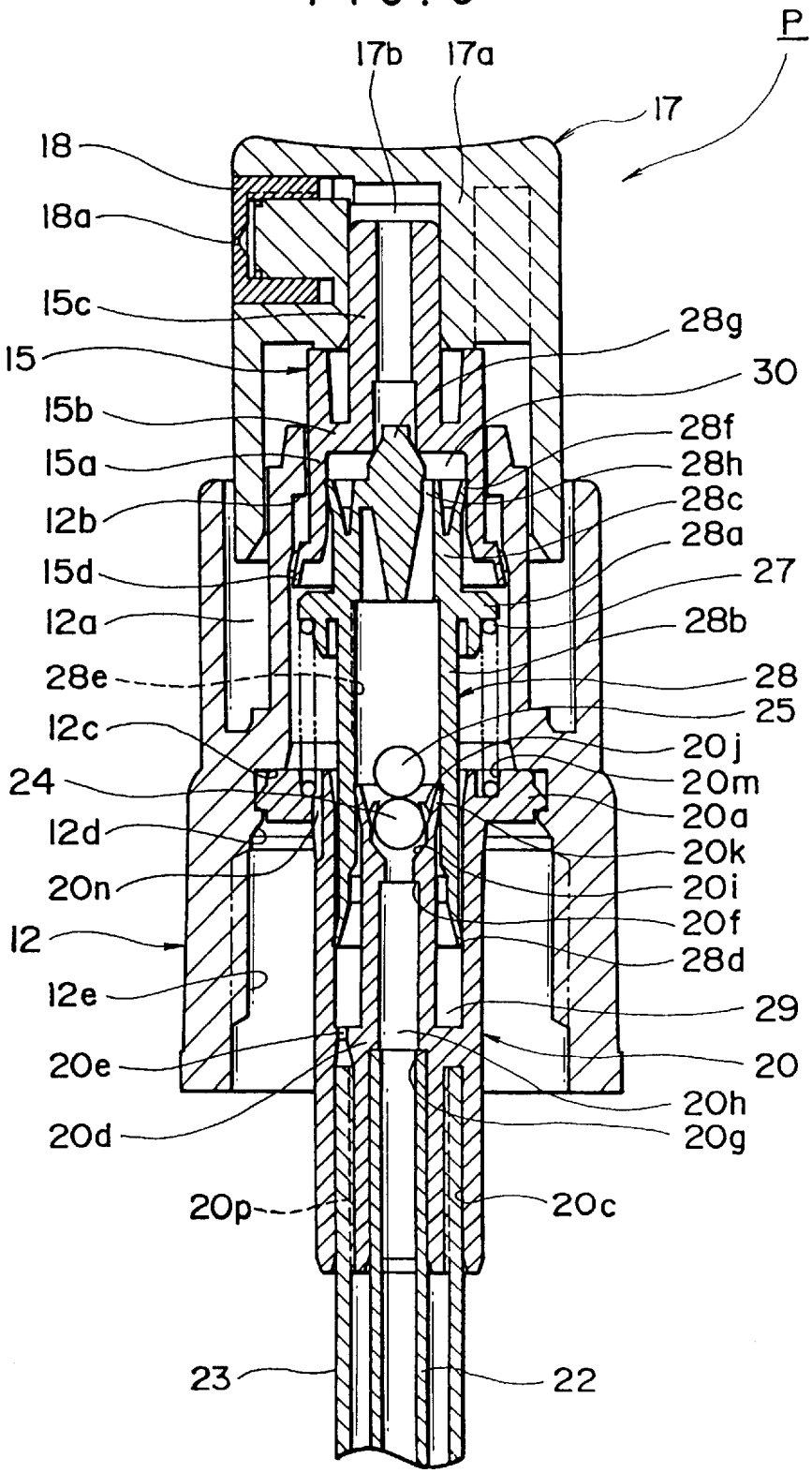
FIG. 5 is a view for showing the state of the push button being released.

Then, when the push button 17 is released by lifting the finger off the push button 17, the piston 28 and the atomizing tube 15 are pushed up together by the energizing member 27. At the time, a negative pressure in the pressure chamber 30 opens the check valve 24 and the inlet of the pressure chamber 30, as shown in FIG. 5. Then the mixture 11 in the container 10 is pumped up to the pressure chamber 30 through the small-diameter pipe 22 and the passage 20*h* and the atomizer finally returns to the condition shown in FIG. 1.

In the atomizer illustrated, when the atomizer is used and the forwarding force of the piston 28 reduces the pumping space from the condition shown in FIG. 1 to the one shown in FIG. 4, the mixture 11 in the pumping space 29 is discharged into the container 10 through the communicating holes 20*e*, groove 23*a*, and the large-diameter pipe 23, thus stirring the mixture 11 in the said container 10.

On the other hand, when the returning force of the piston 28 enlarges the pumping space 29 from the condition shown in FIG. 4 to the condition shown in FIG. 1, the mixture 11 in the container 10 is pumped up into the pumping space 29 through the large-diameter pipe 23, the groove 20*p*, and the communicating holes 20*e*.

As mentioned above, when the atomizer is used, the mixture 11 in the pumping space 29 is discharged into the container 10, the mixture 11 in the said container 10 is stirred, and the mixture 11 stirred can be pumped up into the pressure chamber 30.

On the other hand, in the pressure chamber 30, the flow of the mixture 11 pumped up into the pressure chamber 30 and discharged from the chamber 30 dances the stirring member 25 inside the pressure chamber 30 that moves freely in the said pressure chamber, thus making it possible for the stirring member 25 to stir the mixture 11 in the pressure room 30 sufficiently. The liquid-powder mixture is then atomized through the nozzle 18*a* without precipitating powder in the pressure chamber 30.

Figure 3:
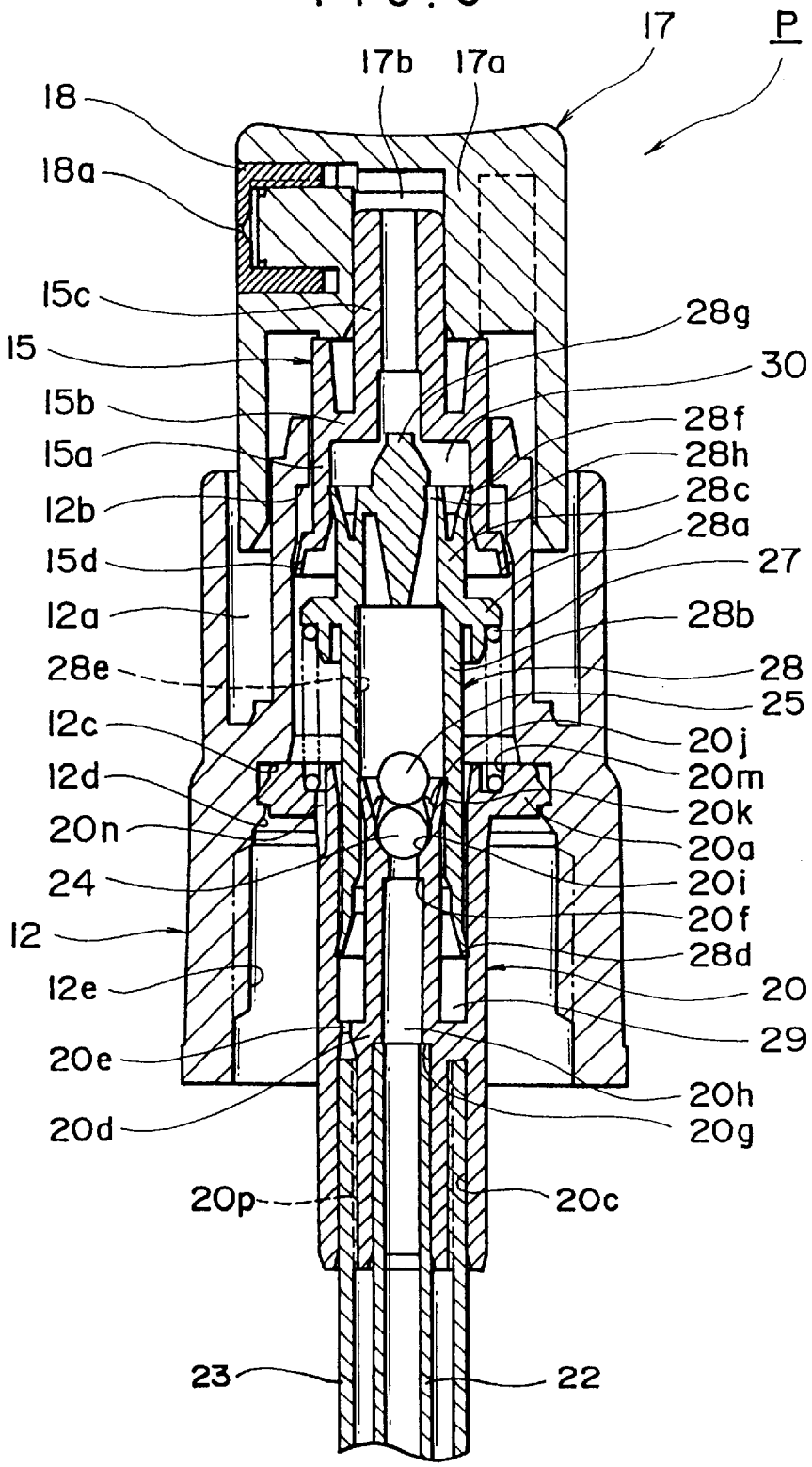
FIG. 3 is a view for showing the state of the reciprocating pump when the push button is pressed when the atomizer is used.

In the first embodiment shown in FIGS. 1 through 5, when the atomizer being used falls into the conditions shown in FIGS. 3 and 4, there is a clearance formed between the outer circumference of the bottom end of the expanding part 15*c* of the atomizing tube 15 and the internal circumference of the fixed cylindrical member 12, thus making the container 10 communicate with the open air through the upward circular concave groove 12*a*, the inside of the push button 17, and the through-hole 20*n*. This helps to prevent the pressure in the container 10 from falling to zero or below and to make it possible to pump up the mixture 11 in the container 10.

Figure 6:
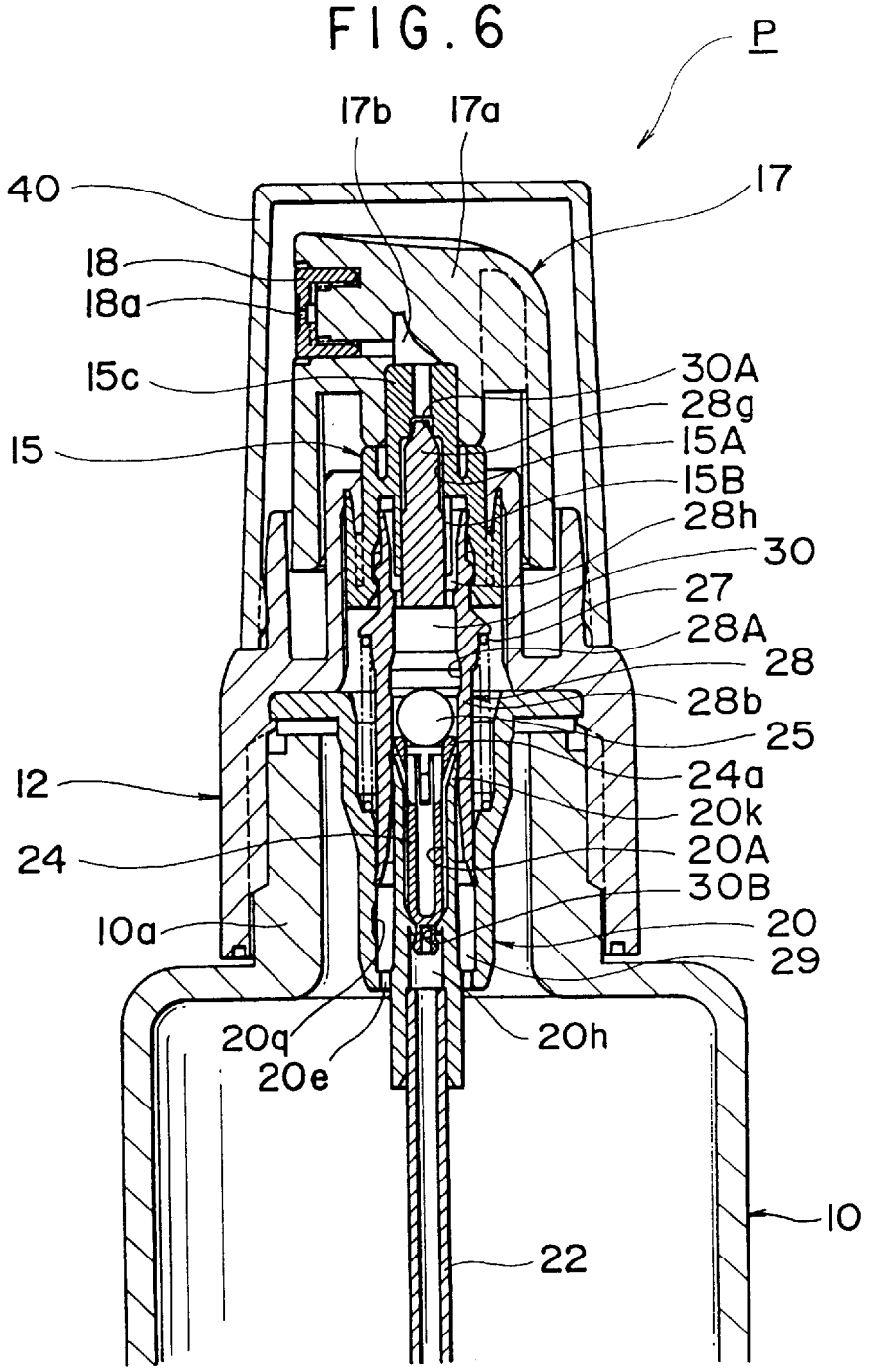
FIG. 6 is a view for showing a partial longitudinal section of another or second embodiment of the atomizer of the reciprocating pump type according to the present invention.

FIGS. 6 through 12 show another or second preferred embodiment of the atomizer of the reciprocating pump type, according to the invention. A part 40 shown in FIG. 6 is a cap provided for the fixed cylindrical member 12 that covers the push button 17. Other reference numerals and symbols used in FIGS. 6 through 12 are the same as used in FIGS. 1 through 5 above-mentioned, so the detailed explanations will not be repeated.

In the preferred first embodiment shown in FIGS. 1 through 5 the outlet of the pressure chamber 30 is used also as the inlet in the small-diameter part 15*c* of the atomizing tube 15 and the outlet valve 28*g* is squeezed against the inlet. In the second embodiment of the invention shown in FIGS. 6–12, however, an outlet 30A of the pressure chamber 30 is provided inside a central opening 15A of the atomizing tube 15 and the outlet valve 28*g* is squeezed against the outlet 30A. The outlet 30A of the pressure chamber 30 communicates with the pressure chamber 30 through the notch 15B of the atomizing tube 15.

In the preferred embodiment of the invention shown in FIGS. 1 and 5, the inlet of the pressure chamber 30 works also as the outlet of the pumping passage 20*h* in the cylinder 20 and the check valve 24 is provided at the outlet. In the second embodiment of the invention, however, the central opening 20A is formed in the cylinder 20 and the inlet 30B of the pressure chamber 30 is provided inside the central opening 20A. The central opening 20A houses the cylinder-shaped check valve 24A to fill the inlet 30B.

Figure 7:
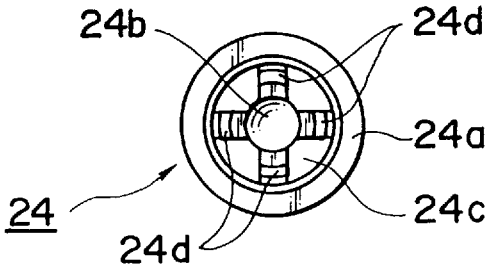
FIG. 7 is a plan and front view of a check valve used for the atomizer shown in FIG. 6.
Figure 7:
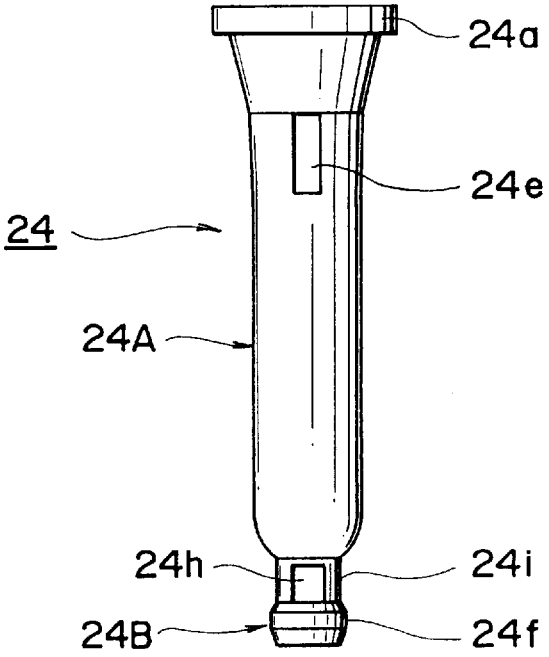
Figure 8:
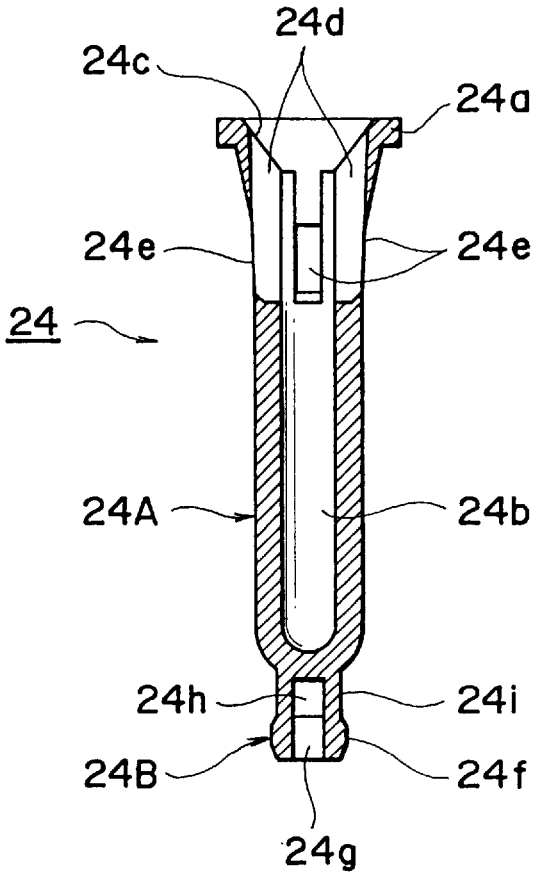
FIG. 8 is a view for showing a longitudinal section of the check valve.

Check valve 24 used in the second embodiment comprises the large-diameter part 24A and the small-diameter part 24B, as shown in FIGS. 7 and 8. The large-diameter part 24A has an elastic collar 24*a* at the top end and a central upward opening 24*b* at the center. There is a chamfered slope 24*c* at the mouth of the central opening 24*b*. In addition, there are plural communicating grooves 24*d* provided in a radial pattern in the top of the central opening 24*b*. Part of each groove leads to the outer circumference, appearing as a through hole under the elastic collar 24*a*.

On the other hand, the small-diameter part 24B has a swollen-looking part 24*f* at the outer circumference of the bottom end and a central downward opening 24*g* at the center. There are plural through holes 24*h* in a radial pattern in the top of the central opening 24*g*. Part of each groove leads to the outer circumference, appearing as a through hole at the outer circumference of the neck 24*i* above the swollen-looking part 24*f*.

When the check valve 24 is housed in the central opening 20A of the cylinder 20, the swollen-looking part 24*f* is squeezed into the inlet 30B of the pressure chamber 30 and the outer circumference of the neck 24*i* is brought in contact with the internal circumference edge of the inlet 30B, thus enabling the check valve 24 to make slight vertical movements. At the time, there is a slight clearance formed between the elastic collar 24*a* of the check valve 24 and the internal circumferential surface of the bore 28*b* of the piston 28.

In the embodiment of the invention shown in FIGS. 1 through 5 above-mentioned, when the push button 17 is completely pressed, the communicating groove 28*e* in the piston 28 reaches the squeezed part 20*k* of the cylinder 20. The pressure chamber 30 then communicates with the passage 20*h* in the cylinder 20 through the communicating concave groove 28*e*, thus making the pressure chamber 30 return to the atmospheric pressure. In the second embodiment of the invention, however, the communicating concave groove 28*e* is replaced by the groove-type concave part 28A in the piston 28. When the groove-type concave part 28A reaches the squeezed part 20*k* of the cylinder 20 with the push button 17 completely pressed, the pressure chamber 30 communicates with the pumping space 29 through the groove-type concave part 28A, thus making the pressure chamber 30 return to the atmospheric pressure. At the same time, the mixture 11 being discharged from the pumping space 29 to the container 10 stirs the mixture 11 in the container 10.

Figure 9:
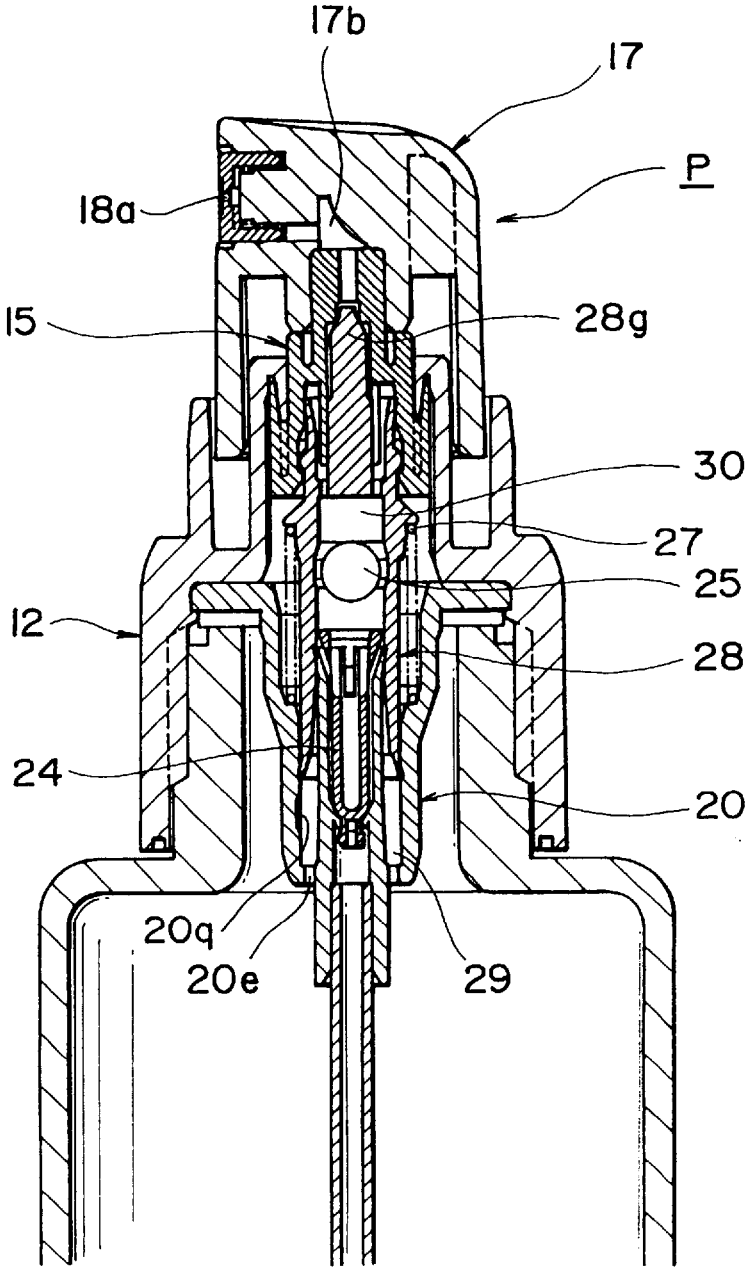
FIG. 9 is a view for showing a longitudinal section of the reciprocating pump in the atomizer shaken before use according to the second embodiment of the present invention.

When the atomizer shown in FIGS. 6 through 12 is used, the container 10 is held in the hand and shaken well to agitate the mixture in the container 10 sufficiently and to allow the stirring member 25, as shown in FIG. 9, to stir the mixture in the pressure chamber 30.

Figure 10:
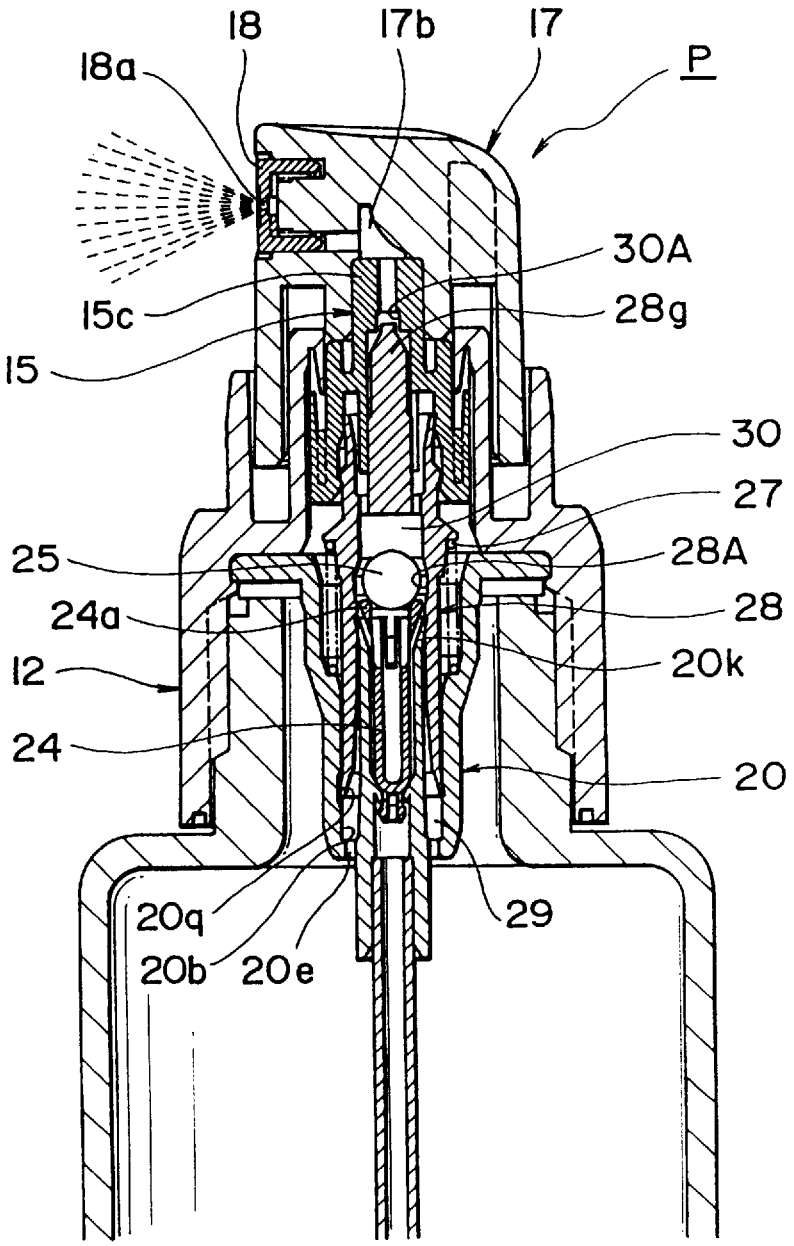
FIG. 10 is a longitudinal sectional view of the reciprocating pump in which the push button is pressed according to the second embodiment of the present invention.

Then, when the push button 17 is pressed against the energizing member 27 by hand, the piston 28 is pushed in through the atomizing tube 15 to increase the pressure in the pressure chamber 30. When the squeezing force of the piston 28 under the pressure of the pressure chamber 30 exceeds the force of the energizing member 27, the piston 28 moving toward the atomizing tube 15, as shown in FIG. 10, releases the squeezing of the outlet valve 28*g* and opens the outlet 30A of the pressure chamber 30, thus making it possible for the small-diameter part 15*c* of the atomizing tube 15 to communicate with the pressure chamber 30. The mixture in the pressure chamber 30 is then sent out to the small-diameter part 15*c*, thus atomizing the mixture 11 through the internal passage 17*b* in the push button 17, with great force, through the nozzle 18*a* of the nozzle member 18 into the open air.

Figure 11:
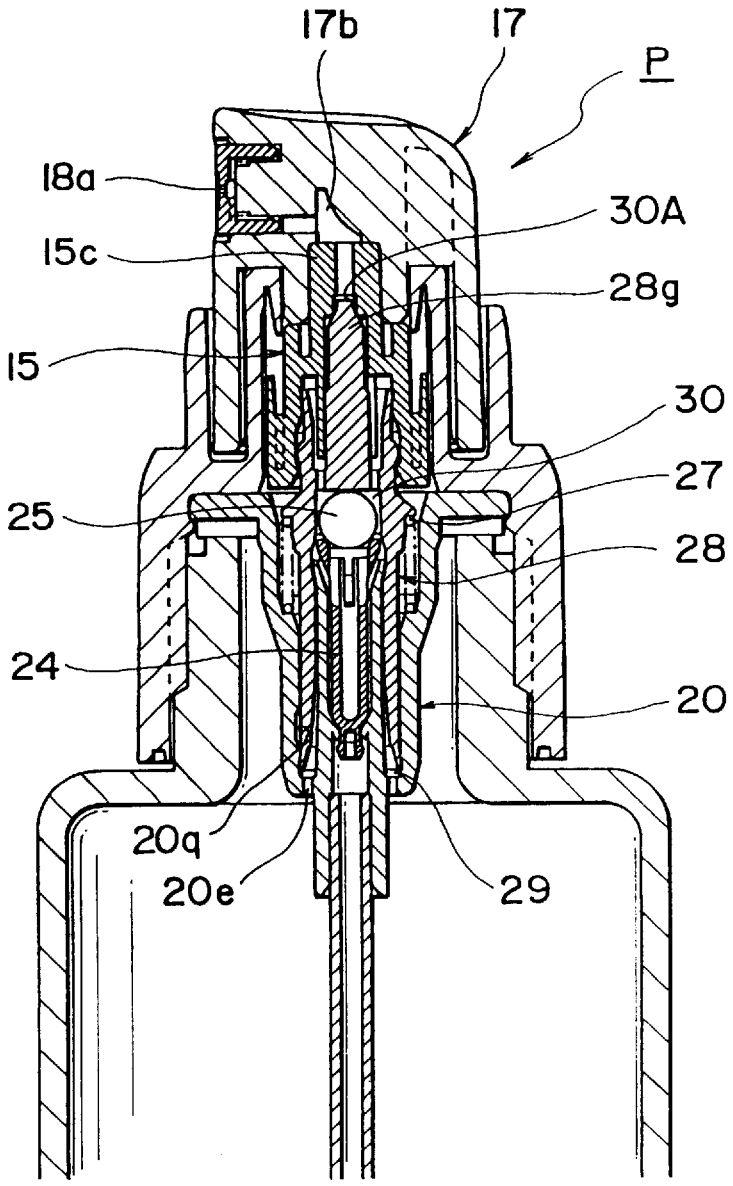
FIG. 11 is a longitudinal sectional view of the last stage of the push-down of the push button pressed.

When the groove-type concave part 28A in the piston 28 reaches the squeezed part 20*k* with the push button 17 completely pressed, the pressure chamber 30 communicates with the pumping space 29 through the groove-type concave part 28A, and then with the container 10 through the communicating holes 20*e*. As a result, the residual pressure is relieved from the pressure chamber 30 through the groove-type concave part 28A into the container 10, thus making the pressure of the pressure chamber 30 return to the atmospheric pressure, as shown in FIG. 11.

Then, the outlet valve 28*g* of the piston 28 is squeezed again against the atomizing tube 15 by the energizing member 27, as illustrated, and the outlet of the pressure chamber 30 is closed, thereby cutting the communication between the small-diameter part 15*c* and the pressure chamber 30 and stopping the atomization through the nozzle 18*a*.

Figure 12:
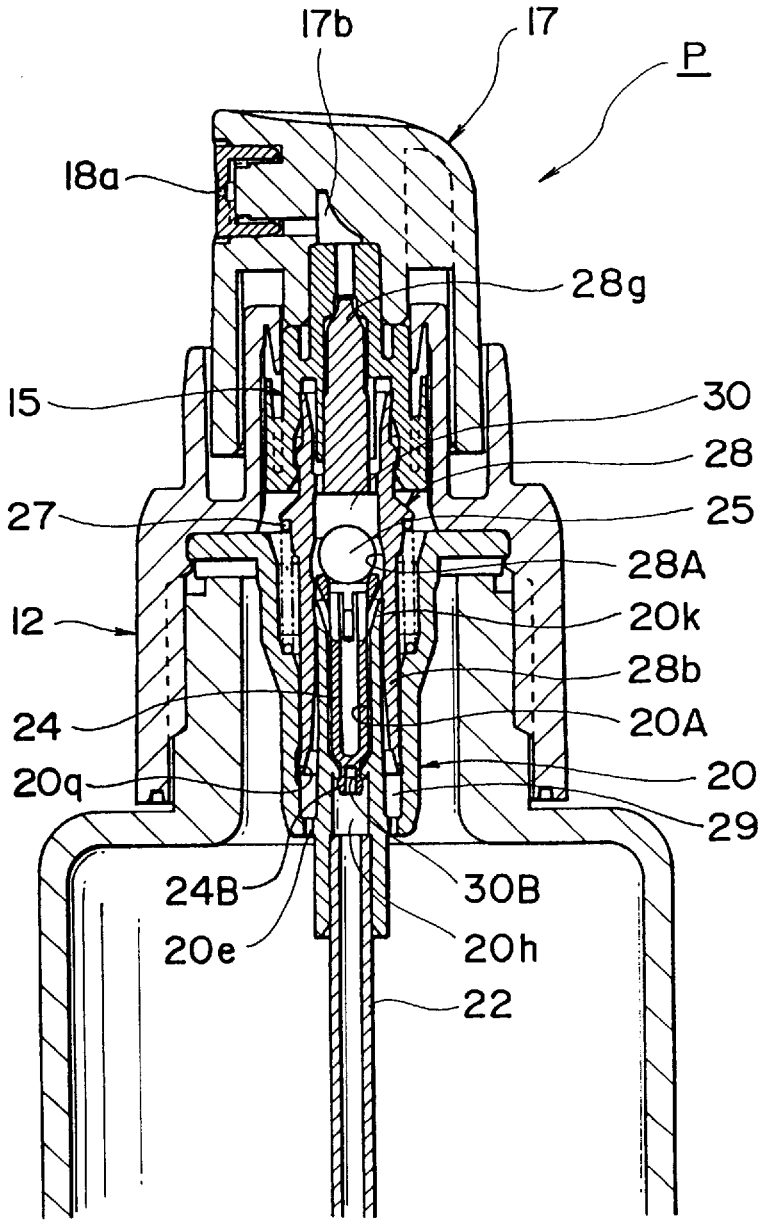
FIG. 12 is a longitudinal sectional view of the released push button.

Then, when the push button 17 is released by lifting the finger off the push button 17, the piston 28 and the atomizing tube 15 are pushed up together by the energizing member 27. At this time, a negative pressure in the pressure chamber 30 raises the check valve 24 and opens the inlet 30B of the pressure chamber 30, as shown in FIG. 12. Then the mixture 11 in the container 10 is pumped up to the pressure chamber 30 through the small-diameter pipe 22, the passage 20*h*, the central opening 24*g* and through-holes 24*h* in the small-diameter part 24B of the check valve 24, the clearance between the outer circumferential surface of the large-diameter part 24A of the check valve 24 and the internal circumferential surface of the central opening 20A of the cylinder 20, and the groove-type concave part 28A. Then the push button 17 is returned to its home position.

On the other hand, in the pressure chamber 30, the flow of the mixture 11 pumped up into the pressure chamber 30 and discharged from the chamber 30 dances the stirring member 25 inside the pressure chamber 30 so that stirring member 25 moves freely in the pressure chamber 30, thus making it possible for the stirring member 25 to stir the mixture in the pressure chamber 30 sufficiently. The liquid-powder mixture is then atomized through the nozzle 18*a* without precipitating powder in the pressure chamber 30.

In the atomizer shown in FIGS. 6 through 12, when the atomizer is in the state shown in FIG. 12, the bottom end of the piston 28 reaches a groove 20*q* formed at the outer circumferential surface of the upward circular hole 20*b* in the cylinder 20 and the inside of the container communicates with the open air, thus preventing a reduction in pressure in the container 10.

In each of the first and second embodiments of the invention, the piston 28 and the outlet valve 28*g* are produced into a single piece. The single piece is squeezed against the outlet of the pressure chamber 30 through the energizing member 27 that energizes the piston 28. However, the outlet valve 28*g* and the piston 28 can be produced as two separate pieces. The piston 28 can be squeezed against the outlet of the pressure chamber 30 through the energizing member separate from the piston. In this case, the atomizing tube 15 and the piston 20 can be produced into a single piece.

Furthermore, in the embodiments of the invention, the pressure chamber 30 is provided mainly in the piston 28. However, the pressure chamber 30 can be provided mainly in the cylinder 20 if the cylinder 20 and the piston 28 are used. In addition, the stirring member 25 need not be of ball-shaped only. Any shape of stirring member can be used so long as the stirring member 25 moves in the pressure chamber 30 and stirs the mixture 11 in the pressure chamber 30.

As mentioned above, according to the present invention, the flow of the mixture in the pressure chamber dances the stirring member when the atomizer is used, thus stirring the mixture in the pressure chamber sufficiently. Therefore, the liquid-powder mixture can be atomized through the nozzle in the push button without any powder precipitating in the pressure chamber.

When the atomizer is used, the mixture in the container is stirred by discharging the mixture in the pumping space through communicating holes. Therefore, the mixture can be pumped up into the pressure chamber without any powder precipitating in the container and the mixture pumped up can be atomized through the nozzle in the push button.

When the atomizer is used, the mixture in the container is stirred before pumped up into the pressure chamber and the mixture pumped up into the pressure chamber is stirred sufficiently by the stirring member before being atomized. Therefore the mixture can be atomized through the nozzle without any precipitating powder.

With the push button completely pressed, the pressure chamber is returned to the atmospheric pressure. When the push button released is returned to its home position, therefore, the mixture in the container can be pumped up into the pressure chamber sufficiently.

The stirring member may be formed like a ball. The ball-shape stirring member can therefore stir the mixture in the pressure chamber more effectively by moving freely in the pressure chamber.

What is claimed is:

1. An atomizer of reciprocating pump type having a mixture of a liquid and powder housed in a container and a reciprocating pump at the mouth of the container which, by pressing and releasing a push button on the reciprocating pump, pumps-up the mixture from said container to a pressure chamber and atomizing the mixture from the pressure chamber through a nozzle in said push button, wherein a stirring member is provided which is movable in the pressure chamber to stir the mixture therein.

2. An atomizer of reciprocating pump described in claim 1, wherein said stirring member is shaped like a ball.

3. An atomizer of reciprocating pump type having a container that houses a mixture of a liquid and powder and a reciprocating pump provided at the mouth of the container, the reciprocating pump comprising:

a push button that is capable of being pressed with a finger in which an internal passage leading to a nozzle is provided, a piston being pushed down when the push button is pressed, a cylinder housing the piston slidably and vertically therein, a pressure chamber formed by the cylinder and said piston and having an inlet leading to the inside of said container and an outlet leading to the internal passage in the push button, an outlet valve provided at the outlet of the pressure chamber that moves against the force energized by the increase of pressure in the pressure chamber when said piston is pushed down by pressing the push button to open the above outlet, an energizing member that returns the push button to its home position together with said piston when the finger becomes separated from the button, a check valve provided at an entrance of said pressure chamber that makes negative the pressure in said pressure chamber when said push button is returned to its home position together with said piston to open the entrance of said pressure chamber; and a stirring member movable within said pressure chamber that stirs said mixture pumped up into said pressure chamber.

4. An atomizer of reciprocating pump described in claim 3 wherein the said stirring member is shaped like a ball.

5. An atomizer of reciprocating pump type having a mixture of a liquid and powder housed in a container and a reciprocating pump at the mouth of the container which, by pressing and releasing a push button on the reciprocating pump, pump-ups mixture from said container to a pressure chamber and atomizing the mixture from the pressure chamber through a nozzle in said push button, said atomizer further comprising a pumping space formed by a piston pushed down when the push button is pressed and a cylinder housing the piston slidably and vertically therein, apart from the pressure chamber, and communicating holes which discharge the mixture that has been pumped up into said pumping space during the return of the push button released to its home position into the container when the push button is pressed.

6. An atomizer of reciprocating pump type having a container that houses a mixture of a liquid and powder and a reciprocating pump provided at the mouth of the container, the reciprocating pump comprising:

a push button that is capable of being pressed with a finger, said push button having an internal passage leading to a nozzle, a piston being pushed down when the push button is pressed, a cylinder housing the piston slidably and vertically therein, a pressure chamber formed by the cylinder and said piston and having an inlet leading to the inside of said container and an outlet leading to the internal passage in the push button, an outlet valve provided at the outlet of the pressure chamber that moves against the force energized by the increase of pressure in the pressure chamber when said piston is pressed by pressing the push button to open the above outlet, an energizing member that returns the push button to its home position together with said piston when the finger becomes separated from the button, a check valve provided at an entrance of said pressure chamber that makes negative the pressure in said pressure chamber when said push button is returned to its home position together with said piston to open the entrance of said pressure chamber; and a pumping space formed by the cylinder and the piston, apart from the pressure chamber, that communicates with said container through communicating holes, holds the mixture pumped up from said container when the push button is returned to its home position with the finger off the push button, and discharges the mixture into said container when the push button is pressed.

7. An atomizer of reciprocating pump type having a mixture of a liquid and powder housed in a container and a reciprocating pump at the mouth of the container which, by pressing and releasing a push button on the reciprocating pump, pumps-up the mixture from said container to a pressure chamber and atomizing the mixture from the pressure chamber through a nozzle in said push button, further comprising:

a stirring member which is movable in the pressure chamber to stir the mixture therein;

a pumping space formed by a piston pushed down when the push button is pressed and a cylinder housing the piston slidably and vertically therein, apart from the pressure chamber, and communicating holes are provided which discharge the mixture that has been pumped up into said pumping space during the return of the push button released to its home position into the container when the push button is pressed.

8. An atomizer of reciprocating pump described in claim 7, wherein said pressure chamber communicates with said pumping space by complete pressing of said push button.

9. An atomizer of reciprocating pump described in claim 8 wherein the said stirring member is shaped like a ball.

10. An atomizer of reciprocating pump described in claim 7 wherein the said stirring member is shaped like a ball.

* * * * *